US009099258B2

(12) United States Patent
Padro

(10) Patent No.: US 9,099,258 B2
(45) Date of Patent: Aug. 4, 2015

(54) ROCKER CONTACT SWITCH FOR ELECTRICAL DEVICE

(75) Inventor: Kenny Padro, Hamden, CT (US)

(73) Assignee: HUBBELL INCORPORATED, Shelton, CT (US)

( * ) Notice: Subject to any disclaimer, the term of this patent is extended or adjusted under 35 U.S.C. 154(b) by 1129 days.

(21) Appl. No.: 13/010,229

(22) Filed: Jan. 20, 2011

(65) Prior Publication Data

US 2012/0186956 A1 Jul. 26, 2012

(51) Int. Cl.

| | |
|---|---|
| ***H01H 75/00*** | (2006.01) |
| ***H01H 73/12*** | (2006.01) |
| ***H01H 1/26*** | (2006.01) |
| *H01H 13/40* | (2006.01) |
| *H01H 71/12* | (2006.01) |

(52) U.S. Cl.

CPC ..... *H01H 1/26* (2013.01); *H01H 13/40* (2013.01); *H01H 71/128* (2013.01)

(58) Field of Classification Search

CPC ..... H01H 1/26; H01H 71/128; H01H 13/40; H01H 83/04; H01H 2071/044

USPC ..... 335/6, 9, 17, 18; 200/239

See application file for complete search history.

(56) References Cited

U.S. PATENT DOCUMENTS

| | | | |
|---|---|---|---|
| 1,928,638 | A | 10/1933 | Avery |
| 2,320,356 | A | 6/1943 | Frank et al. |
| 2,433,917 | A | 1/1948 | McCartney |
| 2,697,149 | A | 12/1954 | Wallace et al. |
| 2,790,859 | A | 4/1957 | Tseng et al. |
| 2,895,119 | A | 7/1959 | Montgomery, Jr. |
| 3,156,761 | A | 11/1964 | Schinske |
| 3,192,499 | A | 6/1965 | West |
| 3,369,211 | A | 2/1968 | Sundquist |
| 3,641,472 | A | 2/1972 | Phillips, Jr. |
| 3,879,101 | A | 4/1975 | McKissic |
| 3,952,244 | A | 4/1976 | Spear |
| 3,967,195 | A | 6/1976 | Averitt et al. |
| 3,975,074 | A | 8/1976 | Fuller |
| 3,975,075 | A | 8/1976 | Mason |
| 4,008,940 | A | 2/1977 | Foley |
| 4,015,201 | A | 3/1977 | Chaffee |
| 4,034,284 | A | 7/1977 | Peplow |
| 4,082,995 | A | 4/1978 | Rhude |
| 4,105,968 | A | 8/1978 | Mobley |
| 4,118,690 | A | 10/1978 | Paynton |
| 4,127,807 | A | 11/1978 | Peplow |

(Continued)

OTHER PUBLICATIONS

SNAPConnect(TM) Get Connected in a Snap with Hubbell (Sales Brochure); www.hubbell-wiring.com; Apr. 2007; 4 pp.

(Continued)

*Primary Examiner* — Bernard Rojas

(74) *Attorney, Agent, or Firm* — Roylance, Abrams, Berdo & Goodman, L.L.P.

(57) ABSTRACT

A rocker contact switch for a GFCI device includes a base and first and second legs extending from the base. When the base is moved, the second leg rotates to contact a conductive member to put the GFCI device in an end of life condition. The first leg is substantially prevented from moving in response to movement of the base. A test button of the GFCI device is pushed a first distance to complete a first circuit that trips the GFCI device. The test button is pushed a second distance, which moves the base of the rocker contact switch, to complete a second circuit that puts the GFCI device in an end of life condition by moving the rocker switch base.

20 Claims, 20 Drawing Sheets

(56) References Cited

U.S. PATENT DOCUMENTS

| | | | | | |
|---|---|---|---|---|---|
| 4,152,639 | A | | 5/1979 | Chaffee | |
| 4,203,638 | A | | 5/1980 | Tansi | |
| 4,215,328 | A | | 7/1980 | Chabot et al. | |
| 4,217,619 | A | | 8/1980 | Tibolla | |
| 4,273,957 | A | | 6/1981 | Kolling, Jr. | |
| 4,280,092 | A | | 7/1981 | Wells, Jr. et al. | |
| 4,477,141 | A | | 10/1984 | Hardesty | |
| 4,485,282 | A | | 11/1984 | Lee | |
| 4,544,219 | A | | 10/1985 | Barkas | |
| 4,725,249 | A | | 2/1988 | Blackwood et al. | |
| 4,842,551 | A | | 6/1989 | Heimann | |
| 4,851,951 | A | * | 7/1989 | Foster, Jr. | 361/50 |
| 4,865,556 | A | | 9/1989 | Campbell et al. | |
| 4,939,615 | A | * | 7/1990 | Brant et al. | 361/42 |
| 5,006,075 | A | | 4/1991 | Bowden, Jr. | |
| 5,015,203 | A | | 5/1991 | Furrow | |
| 5,069,630 | A | | 12/1991 | Tseng et al. | |
| 5,113,045 | A | | 5/1992 | Crofton | |
| 5,117,122 | A | | 5/1992 | Hogarth | |
| 5,146,385 | A | | 9/1992 | Misencik | |
| 5,178,555 | A | | 1/1993 | Kilpatrick et al. | |
| 5,224,009 | A | | 6/1993 | Misencik | |
| 5,266,039 | A | | 11/1993 | Boyer et al. | |
| 5,281,154 | A | | 1/1994 | Comerci et al. | |
| 5,285,163 | A | | 2/1994 | Liotta | |
| 5,297,973 | A | | 3/1994 | Gorman | |
| 5,456,373 | A | | 10/1995 | Ford | |
| 5,472,350 | A | | 12/1995 | Mehta | |
| 5,546,657 | A | | 8/1996 | Mehta et al. | |
| 5,582,522 | A | | 12/1996 | Johnson | |
| 5,625,285 | A | | 4/1997 | Virgilio | |
| 5,642,052 | A | | 6/1997 | Earle | |
| 5,654,857 | A | | 8/1997 | Gershen | |
| 5,781,387 | A | * | 7/1998 | Doyle et al. | 361/49 |
| 5,785,551 | A | | 7/1998 | Libby | |
| 5,839,908 | A | | 11/1998 | Bonilla | |
| 5,876,243 | A | | 3/1999 | Sangawa | |
| 5,917,391 | A | * | 6/1999 | Mahaney et al. | 335/18 |
| 5,964,618 | A | | 10/1999 | McCarthy | |
| 5,975,925 | A | | 11/1999 | Tiberio, Jr. | |
| 5,975,938 | A | | 11/1999 | Libby | |
| 6,028,268 | A | | 2/2000 | Stark et al. | |
| 6,045,374 | A | | 4/2000 | Candeloro | |
| 6,054,849 | A | | 4/2000 | Collier | |
| 6,072,317 | A | | 6/2000 | Mackenzie | |
| 6,156,971 | A | | 12/2000 | May | |
| 6,218,844 | B1 | | 4/2001 | Wong | |
| 6,285,534 | B1 | | 9/2001 | Gibson et al. | |
| 6,309,248 | B1 | | 10/2001 | King | |
| 6,323,652 | B1 | | 11/2001 | Collier | |
| 6,341,981 | B1 | | 1/2002 | Gorman | |
| 6,376,770 | B1 | | 4/2002 | Hyde | |
| 6,377,427 | B1 | | 4/2002 | Haun et al. | |
| 6,457,988 | B1 | | 10/2002 | Andersen | |
| 6,494,728 | B1 | | 12/2002 | Gorman | |
| 6,563,049 | B2 | | 5/2003 | May | |
| 6,657,144 | B2 | | 12/2003 | Savicki, Jr. et al. | |
| 6,692,284 | B1 | | 2/2004 | Koh | |
| 6,737,582 | B2 | | 5/2004 | Van Lieu et al. | |
| 6,753,471 | B2 | | 6/2004 | Johnson | |
| 6,767,245 | B2 | | 7/2004 | King | |
| 6,774,307 | B2 | | 8/2004 | Kruse | |
| 6,814,611 | B1 | | 11/2004 | Torres | |
| 6,843,680 | B2 | | 1/2005 | Gorman | |
| 6,870,099 | B1 | | 3/2005 | Schultz et al. | |
| 6,924,719 | B2 | | 8/2005 | Saruwatari et al. | |
| 6,939,179 | B1 | | 9/2005 | Kieffer, Jr. et al. | |
| 6,982,558 | B2 | | 1/2006 | Bryndzia | |
| 6,994,585 | B2 | | 2/2006 | Benoit et al. | |
| 7,052,313 | B2 | | 5/2006 | Gorman | |
| 7,057,401 | B2 | | 6/2006 | Blades | |
| 7,068,038 | B2 | | 6/2006 | Mason | |
| 7,091,723 | B2 | | 8/2006 | Simmons | |
| 7,189,110 | B1 | | 3/2007 | Savicki, Jr. | |
| 7,195,517 | B1 | | 3/2007 | Savicki, Jr. | |
| 7,199,587 | B2 | | 4/2007 | Hurwicz | |
| 7,248,056 | B2 | | 7/2007 | Waldschmidt | |
| 7,259,567 | B2 | | 8/2007 | Sears | |
| 7,265,291 | B1 | | 9/2007 | Gorman | |
| 7,285,009 | B1 | | 10/2007 | Benoit et al. | |
| 7,289,306 | B2 | | 10/2007 | Huang | |
| 7,367,121 | B1 | | 5/2008 | Gorman | |
| 7,385,406 | B1 | | 6/2008 | Blades | |
| 7,407,410 | B1 | | 8/2008 | Benoit et al. | |
| 7,411,766 | B1 | | 8/2008 | Huang et al. | |
| 7,439,832 | B1 | * | 10/2008 | Radosavljevic et al. | 335/18 |
| 7,470,145 | B1 | | 12/2008 | Savicki, Jr. et al. | |
| 7,497,725 | B2 | | 3/2009 | Savicki, Jr. et al. | |
| 7,501,926 | B2 | | 3/2009 | Watchorn et al. | |
| 7,510,429 | B1 | | 3/2009 | Savicki, Jr. et al. | |
| 7,528,609 | B2 | | 5/2009 | Savicki, Jr. et al. | |
| 7,538,993 | B2 | * | 5/2009 | Huang et al. | 361/42 |
| 7,619,861 | B2 | * | 11/2009 | Weeks et al. | 361/42 |
| 7,722,389 | B2 | | 5/2010 | Benoit et al. | |
| 7,736,175 | B1 | | 6/2010 | Savicki, Jr. et al. | |
| 7,749,018 | B1 | | 7/2010 | Benoit et al. | |
| 7,754,967 | B2 | | 7/2010 | Kruse et al. | |
| 7,762,838 | B2 | | 7/2010 | Gorman | |
| 7,780,470 | B2 | | 8/2010 | Benoit et al. | |
| 8,344,250 | B2 | * | 1/2013 | Padro | 174/53 |
| 2002/0052139 | A1 | | 5/2002 | Gorman | |
| 2002/0055301 | A1 | | 5/2002 | Gorman | |
| 2005/0280962 | A1 | * | 12/2005 | Chan et al. | 361/42 |
| 2006/0103390 | A1 | | 5/2006 | Simmons et al. | |
| 2009/0186500 | A1 | | 7/2009 | Benoit et al. | |
| 2009/0197461 | A1 | | 8/2009 | Benoit et al. | |
| 2013/0242440 | A1 | * | 9/2013 | Bonasia et al. | 361/49 |

OTHER PUBLICATIONS

Leviton Maunfacturing Co., Inc.; lev-lok(TM) Modular Receptacles (Sales Brochure); www.leviton.com/industrial; 2008; 5 pp.

Leviton Manufacturing Co., Inc.; The Wire Simplifier lev-lok(R) (Sales Brochure); www.leviton.com/industrial; 2009; 2 pp.

Cooper Industries, Ltd.; ArrowLink(TM) Modular Wiring Devices; Cooper Wiring Devices (Sales Brochure); www.cooperwiringdevices.com; 2009; 28 pp.

Richter et al., Practical Electrical Wiring, 1993, 16th Edition, McGraw-Hill, U.S.; pp. 137-139, 176-177, 507-510.

Bryant Wiring Device Catalog BDB-1506, May 1994, pp. C12, D12, D16, F2 and F5.

Leviton Wiring Device Catalog, D-200, 1978, Little Neck, NY, pp. C1, T9, T12.

Pass & Seymour Plug Tail Wiring Devices Brochure; Apr. 2004.

First Alert, User's Manual for Smoke and Fire Alarms, Jul. 2004; Mexico, pp. 1-6.

Earley et al., NEC 1999 National Electrical Code Handbook, NFPA, 8th ed. (1999) pp. v-vii, 2, 69-70 and 98.

BRK Electronics, Users Manual—Smoke Alarms Jun. 2000.

T. Engdahl, Telephone Ringing Circuits, 1997, www.tkk.fi/misc/electronics/circuits/telephone_ringer.html.

P&S Plug Tail Installation—Speed Comparison Video, Pass & Seymour website (www.passandseymour.com/plugtail/video.cfm, Jun. 2007.

BRK Electronics (First Alert), Model SC6120B—User's Manual for AC Powered Smoke and Carbon Monoxide Alarm with Battery Back-Up and Silence Feature, 2001.

NEC 2005 Handbook, 2005, Article 314-17, Conductors Entering Boxes, Conduit Bodies, or Fittings, National Flre Protection Association, Inc. p. 327.

UL Standard 514A, Metallic Outlet Boxes, Underwrites Laboratories Inc., Tenth Edition, 2004, p. 39.

* cited by examiner

ROCKER CONTACT SWITCH FOR ELECTRICAL DEVICE

FIELD OF THE INVENTION

The present invention relates to a rocker contact switch for an electrical device. More particularly, the present invention relates to a GFCI device having a rocker contact switch adapted to transfer movement of the base of the rocker contact switch into movement of a leg of the rocker contact switch. Still more particularly, the present invention relates to a GFCI device that substantially prevents being put in an end-of-life condition prior to being tripped.

BACKGROUND OF THE INVENTION

GFCI devices are designed to trip in response to the detection of a ground fault condition at an alternating current (AC) load. Generally, the ground fault condition results when a person or object comes into contact with the line side of the AC load and an earth ground at the same time, a situation which can result in serious injury.

GFCI devices interrupt a circuit path, typically at an AC receptacle, in response to the detection of a ground fault condition at an AC load. Ground fault circuit interrupters are used in utility power applications to protect against leakage currents that flow through ground rather than back through the source's neutral line. They are commonly found in residential settings where the utility power is used to operate household appliances. In operation, a GFCI type device supplies electricity to an exterior circuit and opens an outlet circuit when a ground fault occurs in the exterior circuit, i.e., when a portion of a circuit that is plugged into the outlet becomes grounded. GFCI devices commonly include a differential current transformer, control circuit, and a circuit breaker device. Typically, a GFCI device detects this condition by using a sensing transformer or wire coil to detect an imbalance between the currents flowing in the hot and neutral conductors of the AC supply, as will occur when some of the current on the line side is being diverted to ground. A ground fault condition occurs when the current is diverted to the ground through another path, such as a human body, that results in an imbalance between the currents flowing in the hot (phase) and neutral conductors. When such an imbalance is detected, a circuit breaker within the ground fault circuit interrupter is immediately tripped to an open condition, thereby opening both sides of the AC line and removing all power from the AC load.

GFCI devices may be connected to fuse boxes or circuit breaker panels to provide central protection for the AC wiring throughout a commercial or residential structure. More commonly, however, GFCI devices are incorporated into electrical receptacles that are designed for installation at various locations within a building. This type of receptacle includes test and reset pushbuttons and a lamp or light-emitting diode (LED) indicating that the circuit is operating normally. When a ground fault occurs in the protected circuit, or when the test button is depressed, the GFCI device trips and an internal circuit breaker opens both sides of the AC line. The tripping of the circuit breaker causes the reset button to pop out and the LED to be extinguished, providing a visual indication that a ground fault has occurred. To reset the GFCI device, the reset button is depressed in order to close and latch the circuit breaker and to illuminate the LED once again.

To trip the GFCI device, the test button is depressed, thereby contacting a spring beam and moving it toward a resistor lead. When the spring beam contacts the resistor lead, the GFCI device is tripped. Further depressing the test button, causes further movement of the spring beam. When the spring beam contacts a diode lead, the GFCI device is put in an end-of-life condition. One of the problems with conventional GFCI devices is that when the test button is depressed too quickly, the spring beam bows, such that the spring beam contacts the diode lead before contacting the resistor lead. This premature contacting of the diode lead results in a good GFCI device being improperly put in an end-of-life condition. Thus, a good GFCI can no longer be used and must be replaced, thereby causing an inconvenience to the user.

Additionally, the spring beam contacts either the resistor or diode lead to put the GFCI device into the tripped or end-of-life condition, respectively. Thus, the same member, i.e., the spring beam, is moved to put the GFCI device into one of the two conditions, thereby increasing the likelihood of the GFCI device being put into the incorrect condition. Accordingly, a need exists for a GFCI device in which more than one member is moved to put the GFCI device in the tripped and end-of-life conditions.

Accordingly, a need exists for a GFCI device that substantially prevents being put in an end-of-life condition prior to being tripped.

SUMMARY OF THE INVENTION

Accordingly, it is a primary objective of the present invention to provide an improved contact switch that is engaged by a spring beam of a GFCI device to put the GFCI device in tripped and end-of-life conditions.

Another objective of the present invention is to provide a rocker switch for a GFCI device that translates movement of a first distance in a first direction into movement in a second and perpendicular direction of a second distance approximately two-and-a-half times that of the first distance.

A further objective of the present invention is to provide a GFCI device that is substantially prevented from entering an end-of-life condition prior to being tripped.

A still further objective of the present invention in which a first member is moved to put the GFCI device in a tripped condition and a second member is moved to put the GFCI device in an end-of-life condition.

The foregoing objectives are basically attained by a rocker contact switch for a GFCI receptacle that includes a movable base and a fixed first leg and a movable second leg extending from the base. The first leg has a first portion and a second portion. The second portion is mechanically and electrically engagable with a wire inserted in the GFCI receptacle. When the base is moved, the second leg is moved to contact a conductive member to put the GFCI receptacle in an end of life condition. The first portion of the first leg remains substantially stationary during movement of the base.

The foregoing objectives are also basically attained by a GFCI receptacle having a housing and a button accessible on an outer surface of the housing and movable be first and second distances relative to the housing. A spring beam is movable within the housing and engaged by the button when the button moves to cause tripping of the GFCI device. A rocker contact switch disposed in the housing has a movable base from which a fixed first leg and a movable second leg extend. The first leg has a first portion and a second portion. The second portion is mechanically and electrically engagable with a wire inserted in the GFCI receptacle. When the button is pushed a first distance, the button moves the spring beam to contact the base, thereby tripping the GFCI receptacle. When the button is pushed a second distance, the button moves the spring beam to engage the base such that the second leg moves to contact a conductive member to put the GFCI receptacle in an end of life condition.

The foregoing objectives are also basically attained by a method of operating a GFCI device. A button on the GFCI device is pushed a first distance to complete a first circuit by engaging a spring beam with a base of a rocker contact switch to trip the GFCI device. The button is pushed a second distance to complete a second circuit by moving the spring beam to move the base such that a second leg moves to contact a conductive member to put the GFCI receptacle in an end of life condition.

Other objects, advantages and salient features of the invention will become apparent from the following detailed description, which, taken in conjunction with the annexed drawings, discloses preferred embodiments of the invention.

As used in this application, the terms "front," "rear," "upper," "lower," "upwardly," "downwardly," and other relative orientational descriptors are intended to facilitate the description of the switch assembly, and are not intended to limit the structure of the switch assembly to any particular position or orientation.

BRIEF DESCRIPTION OF THE DRAWINGS

The above aspects and features of the present invention will be more apparent from the description for exemplary embodiments of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
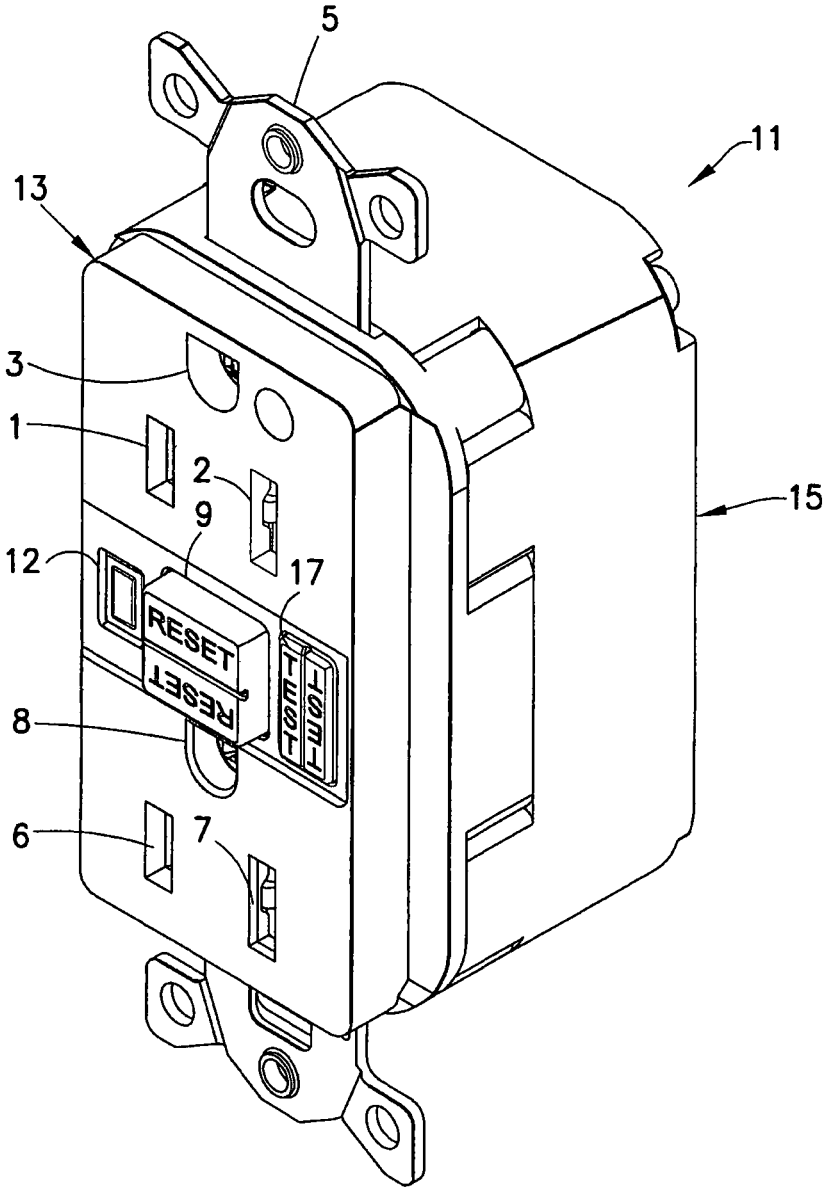
FIG. 1 is a front perspective view of a GFCI device according to a first exemplary embodiment of the present invention.

A rocker contact switch 21 in accordance with a first exemplary embodiment of the present invention for a GFCI device 11 (FIG. 1) or 11*a* (FIG. 8) is shown in FIGS. 1-18, although the contact switch can be used with any suitable electrical device. The rocker contact switch 21, as shown in FIGS. 12-15, has a base 23 and first and second legs 25 and 27 extending therefrom. The first leg 25 has a first portion 26 and a second portion 28. The second portion 28 is adapted to mechanically and electrically engage a wire 10 inserted in the GFCI device 11, as shown in FIGS. 7 and 8. When the base 23 is moved, the second leg 27 is adapted to move to contact a conductive member to put the GFCI device 11 in an end of life condition. The first portion 26 of the first leg 25 is substantially prevented from moving in response to the base 23 being moved.

Figure 2:
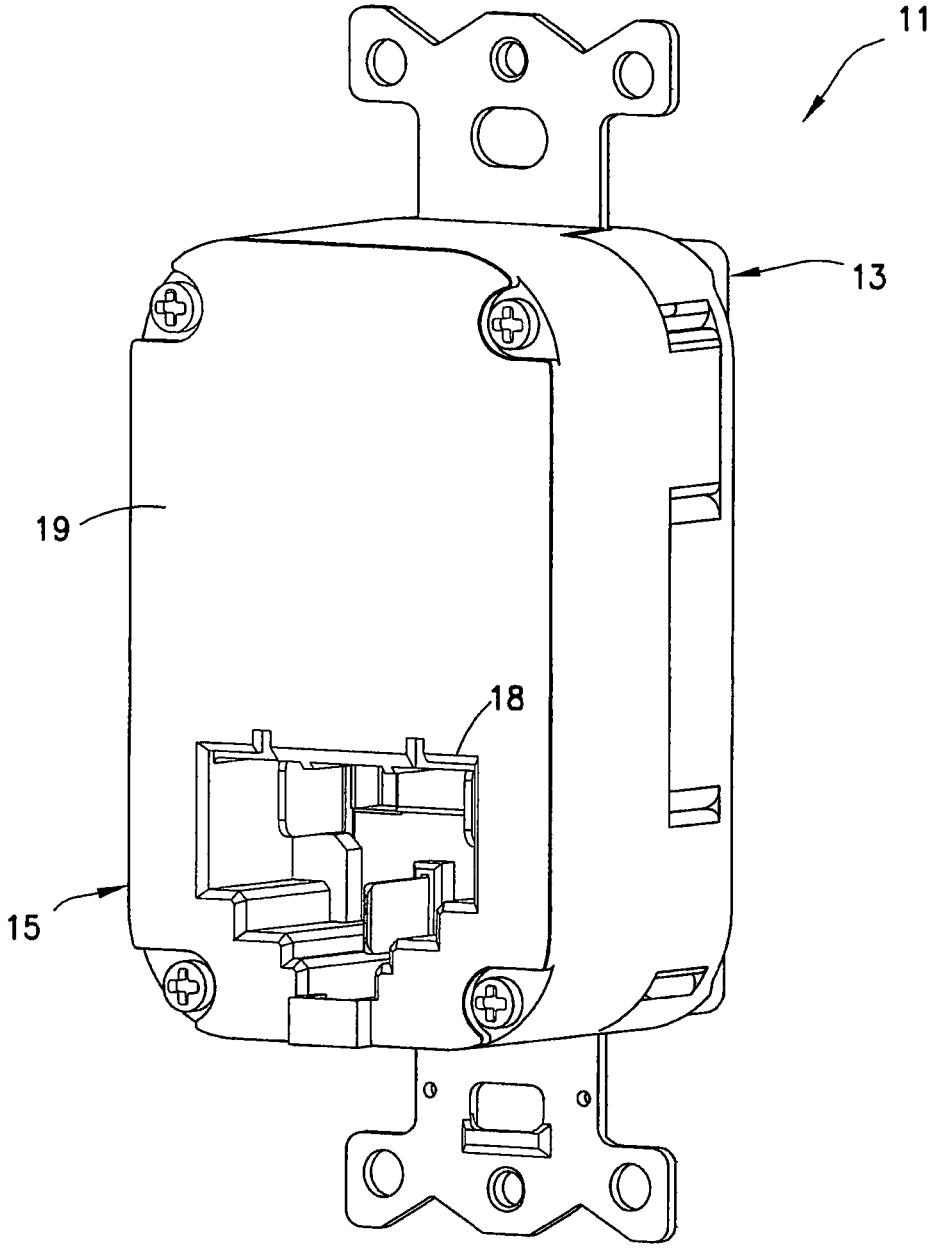
FIG. 2 is a rear perspective view of the GFCI device of FIG. 1.
Figure 3:
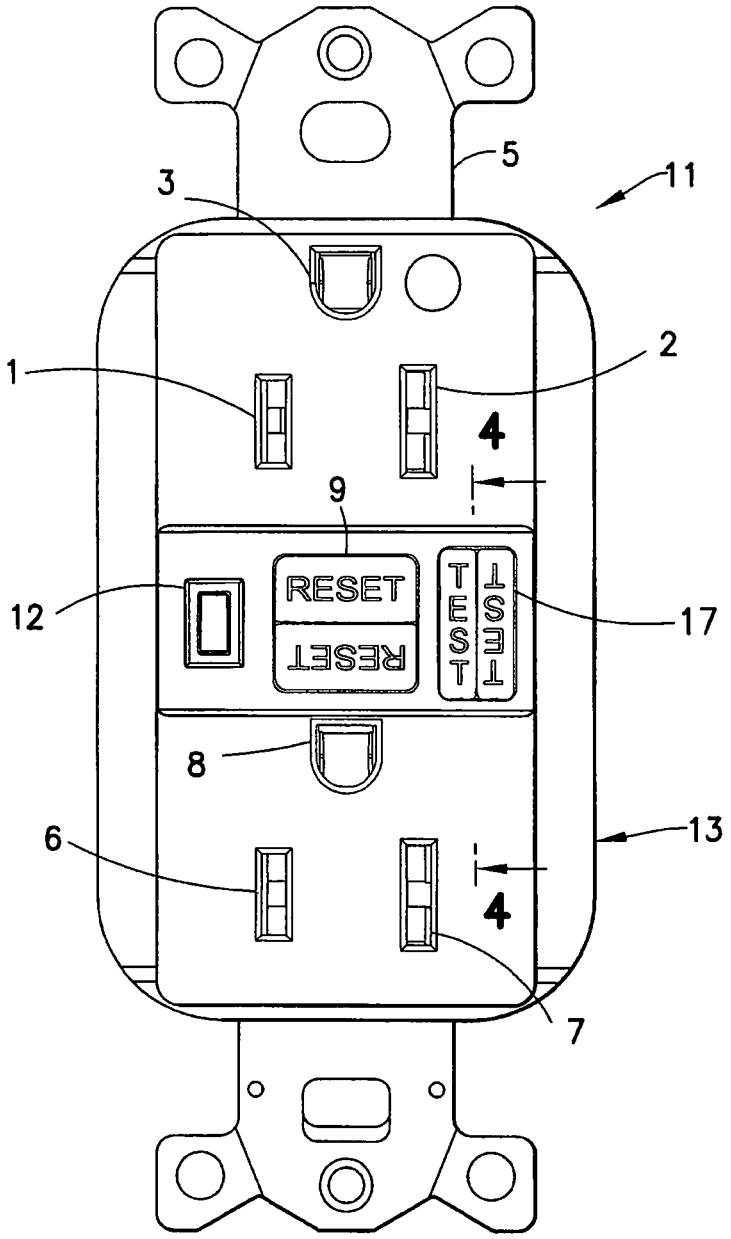
FIG. 3 is a front elevational view of the GFCI device of FIG. 1.
Figure 8:
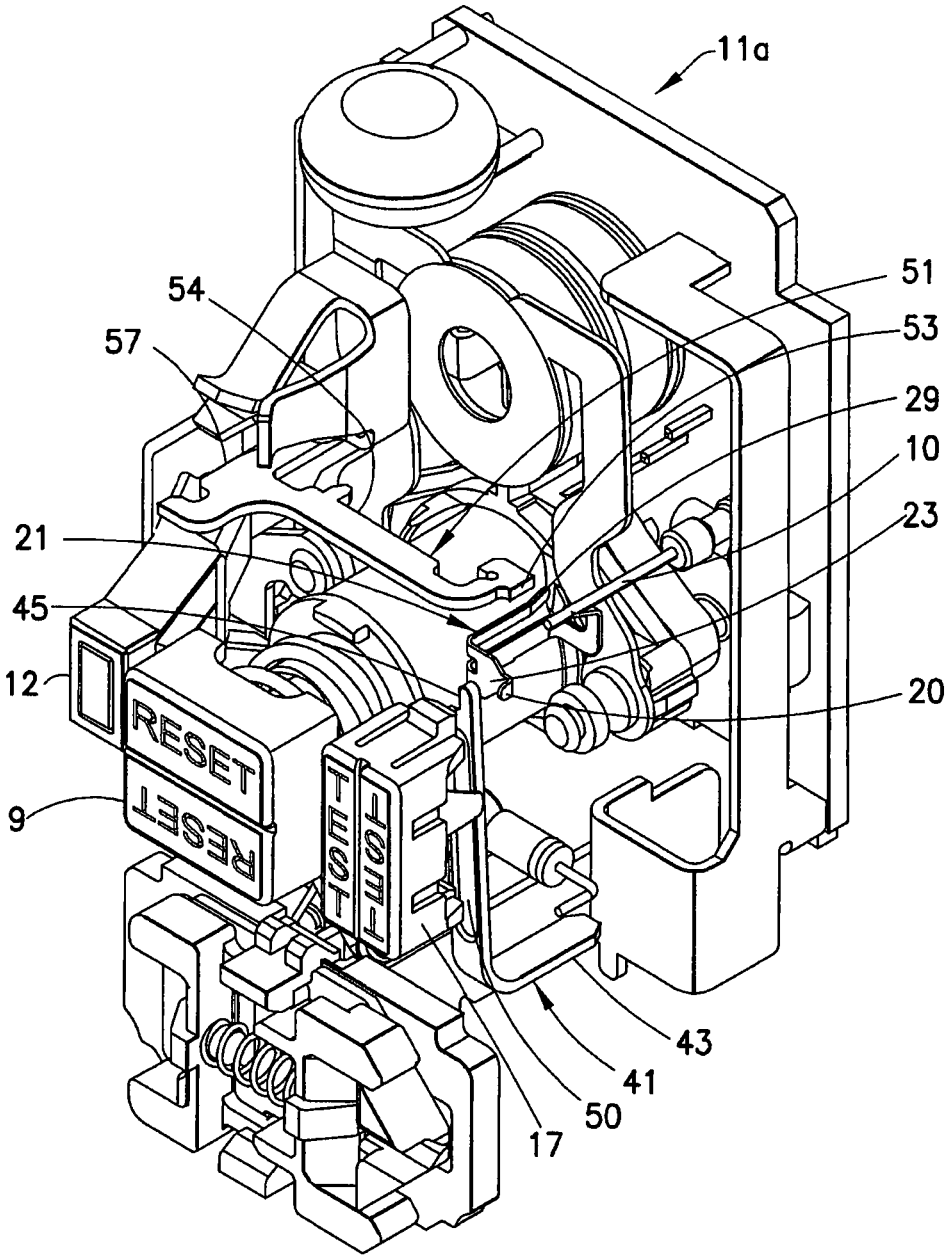
FIG. 8 is a perspective view of a GFCI device according to a second exemplary embodiment of the present invention.
Figure 9:
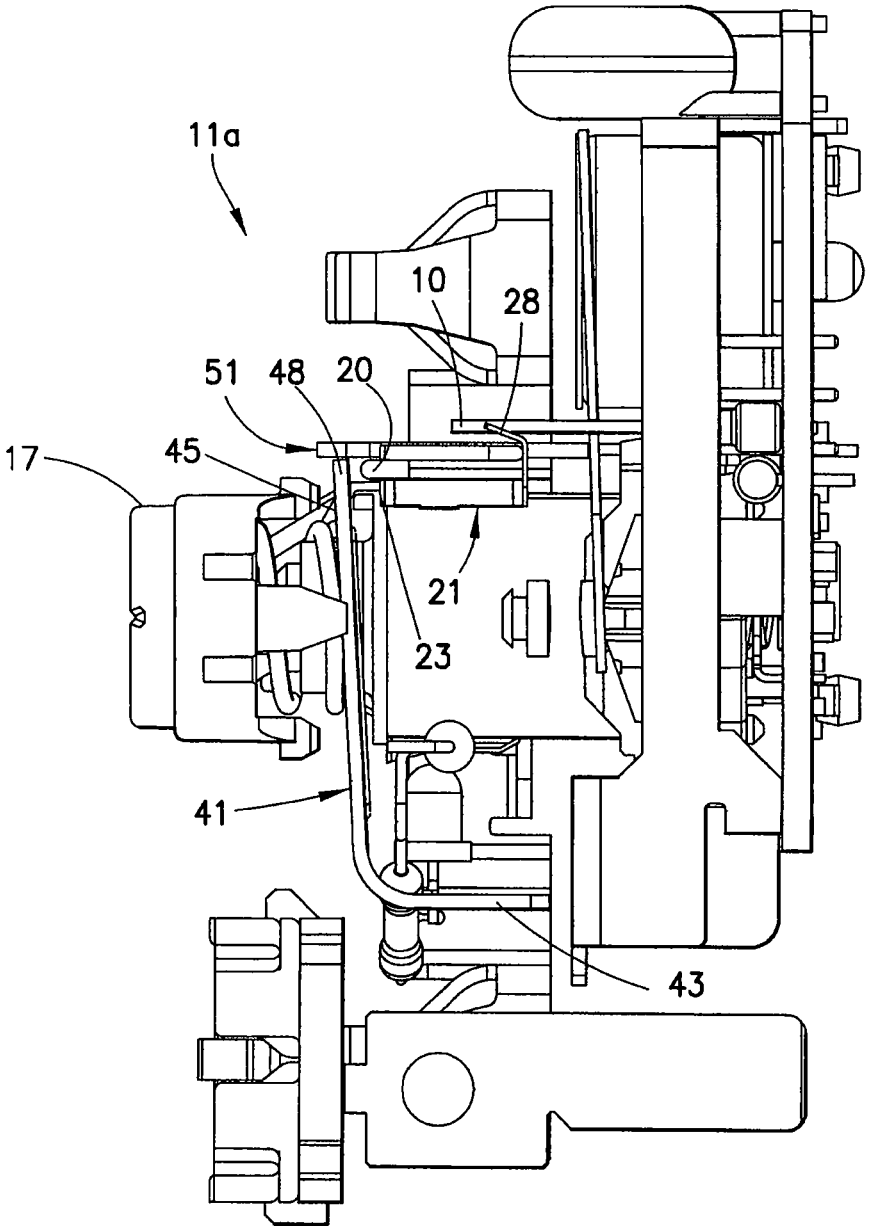
FIG. 9 is a partial side elevational view in partial cross section of the GFCI device of FIG. 9.
Figure 10:
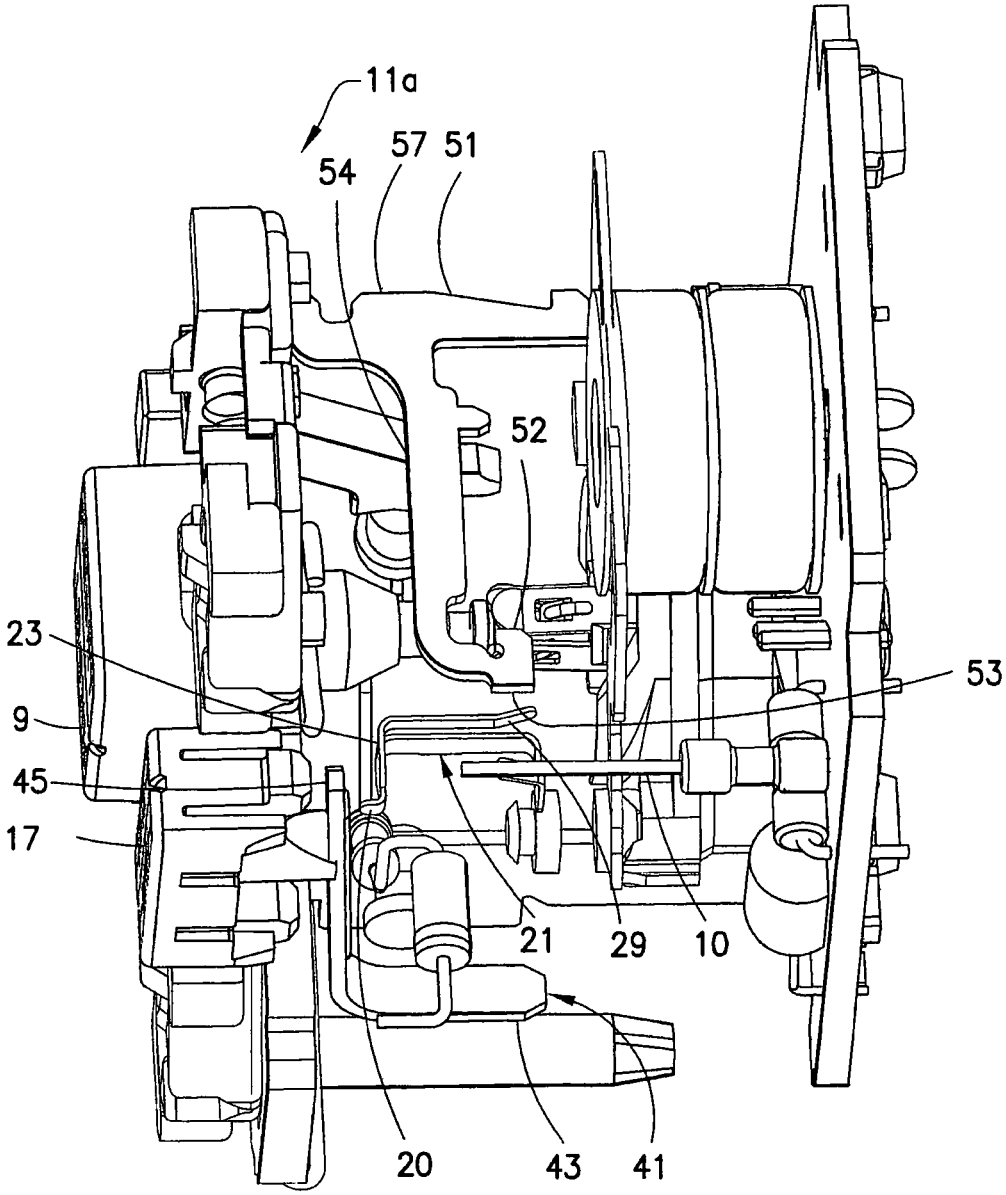
FIG. 10 is a side perspective view of the GFCI device of FIG. 9.
Figure 11:
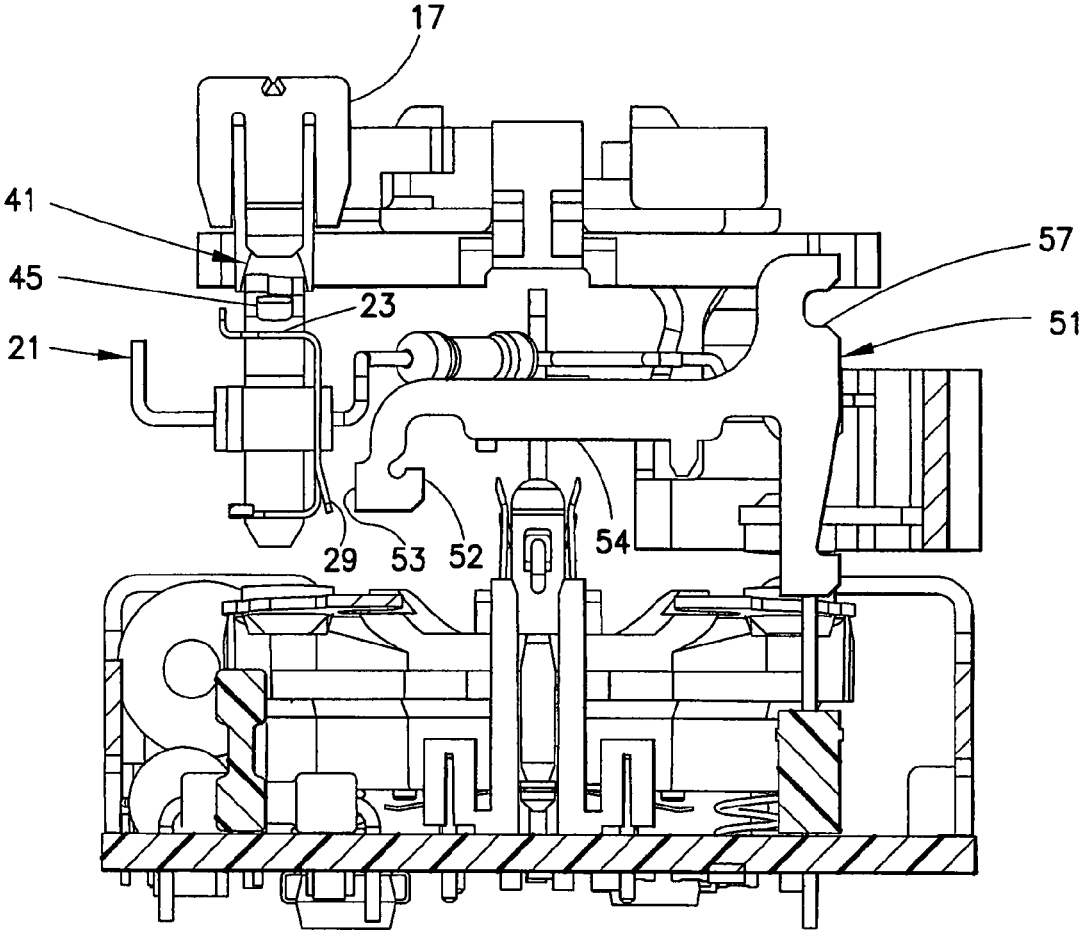
FIG. 11 is a side elevational view in partial cross section a rocker contact switch for a GFCI device according to a first exemplary embodiment of the present invention.

The GFCI device 11 includes a cover 13 connected to a base 15, as shown in FIGS. 1-3. A mounting strap 5 is connected to the GFCI device to facilitate mounting the GFCI device to an electrical box. A test button 17 is movably connected to the cover 13. A reset button 9 is movably connected to the cover 13 proximal the test button 17. A status indicator 12, such as an LED light, is disposed on the cover 13 to indicate when the GFCI device is in an end-of-life condition. A first plurality of openings 1, 2 and 3 are formed in the cover 13 to receive a first plug. A second plurality of openings 6, 7 and 8 are formed in the cover 13 to receive a second plug. The rear surface 19 of the base 15 has an aperture 18 for receiving a plug that terminates wires that supply electrical power. Alternatively, a plurality of push-in openings may be provided in the rear surface, thereby allowing the electrical power supply wires to be terminated by being pushed into the GFCI device 11*a* (FIGS. 8-10).

As noted above, the rocker contact switch 21, as shown in FIGS. 12-15, includes a base 23 having first and second legs 25 and 27, respectively, extending therefrom. A tab 20 extends upwardly from the base 23 at an end thereof opposite legs 25 and 27 in a direction substantially opposite to that in which the first and second legs 25 and 27 extend. Preferably, the tab 20 is substantially perpendicular to the base 23. The tab 20 substantially prevents a spring beam 41 from moving off the base 23 when the spring beam engages the base of the rocker contact switch 21. Preferably, the rocker contact switch 21 is made of stainless steel.

Figure 12:
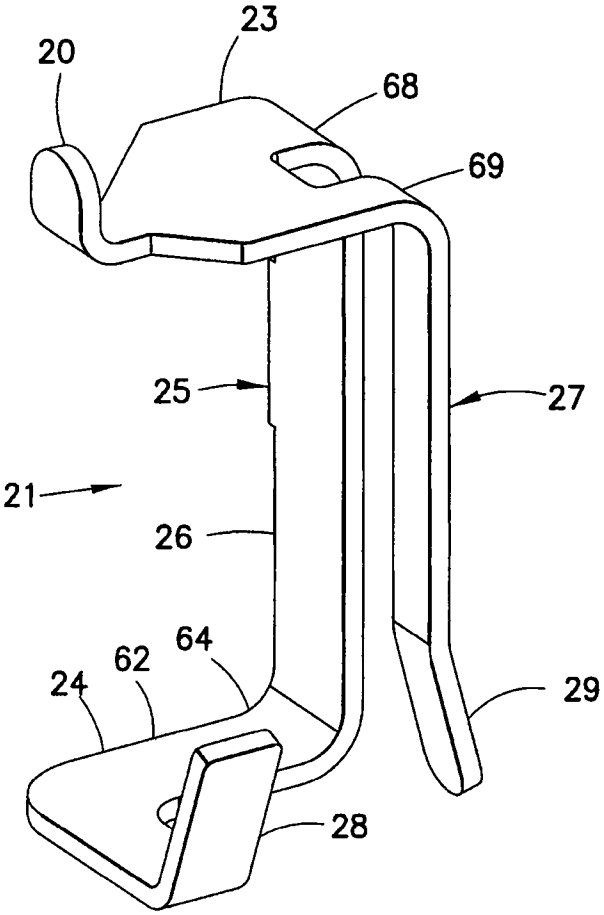
FIG. 12 is a perspective view of the rocker contact switch of FIG. 11.
Figure 14:
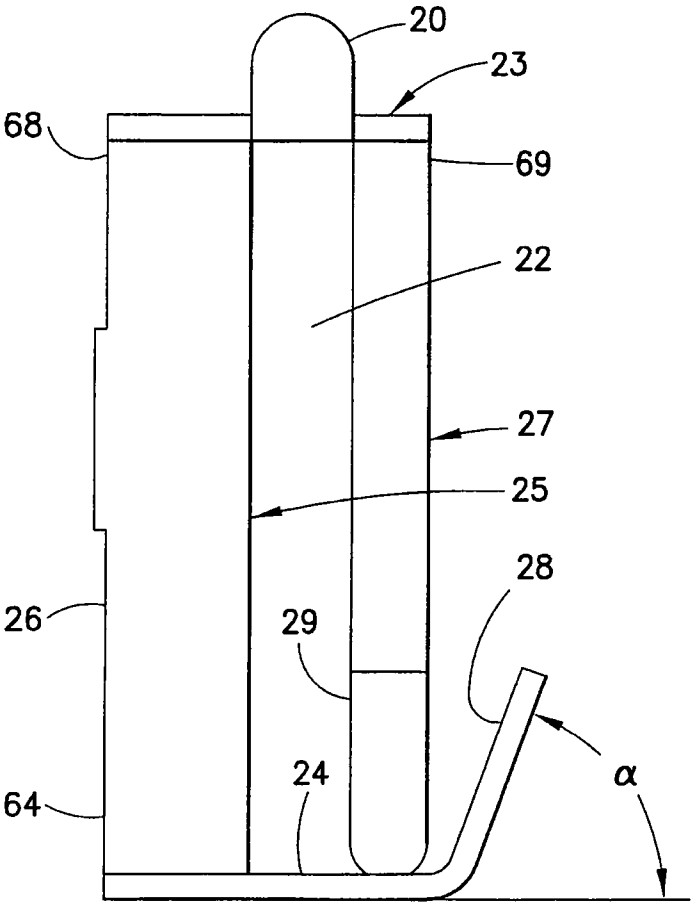
FIG. 14 is a front elevational view of the rocker contact switch of FIG. 12.

The first leg 25 has first portion 26 joined to base 23 by a right angle bend 68 and second portion 24 joined to the end of first portion 26 opposite base 23. The second portion 24 has a planar portion 62 connected to the first portion 26 by a right angle bend 64 and a first angled portion 28 adapted to mechanically and electrically engage a wire that is terminated by inserting the wire in the GFCI device 11*a*. Preferably, the planar portion 62 is substantially L-shaped, as shown in FIG. 12, and the angled portion 28 is disposed at an end thereof. The first angled portion 28 of the first leg 25 has an angle α to facilitate receiving the inserted wire 10 (FIG. 8), as shown in FIG. 14. The angle α is determined by the diameter of the wire 10 being inserted in the GFCI device. Preferably, the angle α is approximately 70 degrees with respect to a planar portion of the second portion 24 of the first leg 25.

Figure 13:
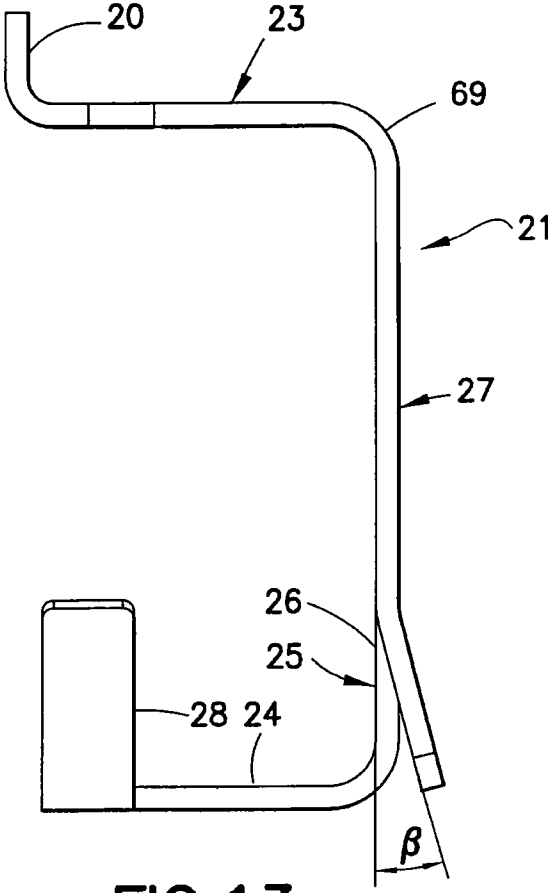
FIG. 13 is a side elevational view of the rocker contact switch of FIG. 12.
Figure 15:
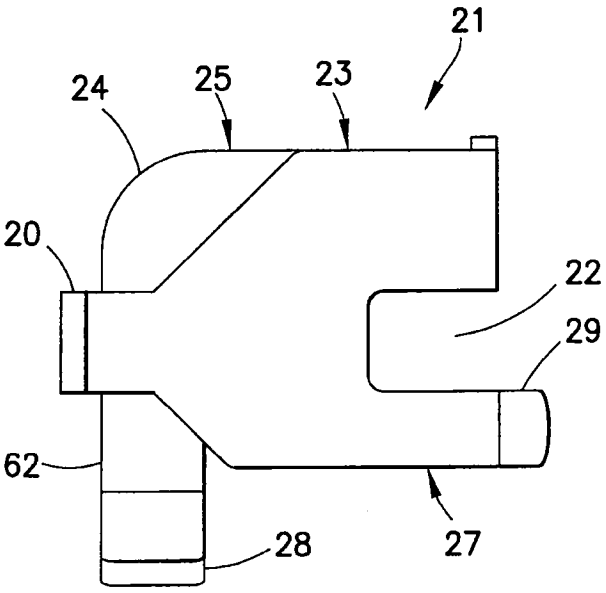
FIG. 15 is a top plan view of the rocker contact switch of FIG. 12.

The second leg 27 of the rocker contact switch 21 is joined to base 23 by a right angle bend 69 laterally adjacent first leg 25 and is preferably substantially parallel to the first portion 26 of the first leg 25, as shown in FIGS. 12-14. The second leg 27 has a second angled portion 29 having an angle β relative to the longitudinal axis of second leg 27 to facilitate engaging the conductive member 54, as shown in FIG. 13. Preferably, the angle β is approximately 14 degrees with respect to the non-angled portion of the second leg 27. A gap 22 spaces the first portion 26 of the first leg from the second leg 27, as shown in FIGS. 14 and 15, such that the second leg is movable with respect to the first leg.

Figure 16:
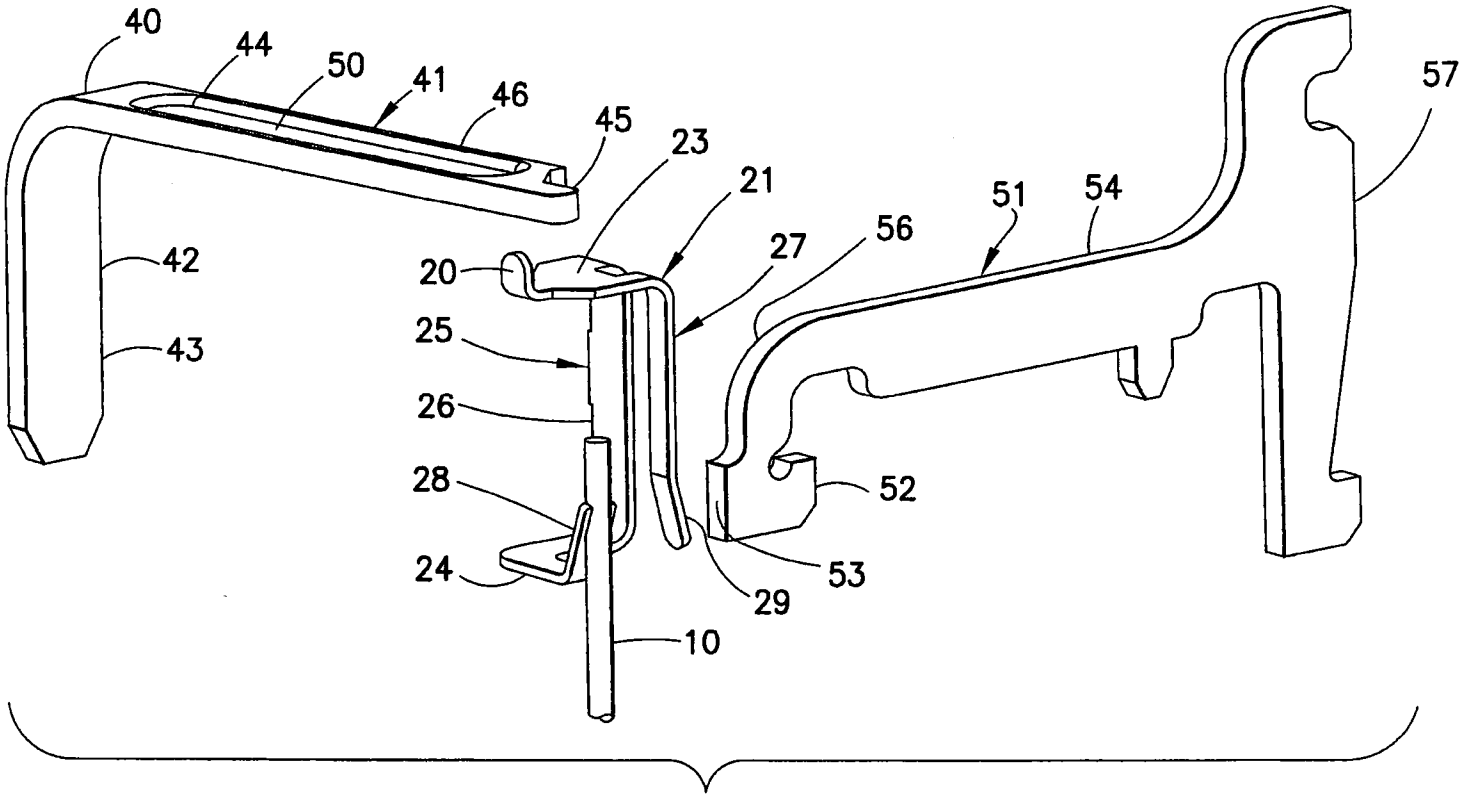
FIG. 16 is a perspective view of the rocker contact switch of FIG. 12 prior to being engaged by a spring beam.

The spring beam 41 is movably disposed in the base 15 of the GFCI device 11, as shown in FIGS. 4-11. The spring beam 41 has a fixed end 43 and a free end 45. As shown in FIG. 16, the spring beam 41 is substantially L-shaped and has a first portion connected to a second portion by a right angle bend 40. An upper surface 46 of the spring beam 41 is engaged by the test button 17. A slot 50 in the upper surface 46 facilitates engaging the test button 17. A lower surface 48 of the free end engages the base 23 of the rocker contact switch 21. A strengthening gusset may be disposed in the free end 45 of the spring beam 41 to substantially prevent bowing of the spring beam when engaged by the test button 17. Preferably, the spring beam 41 is made of brass or brass alloy.

Figure 4:
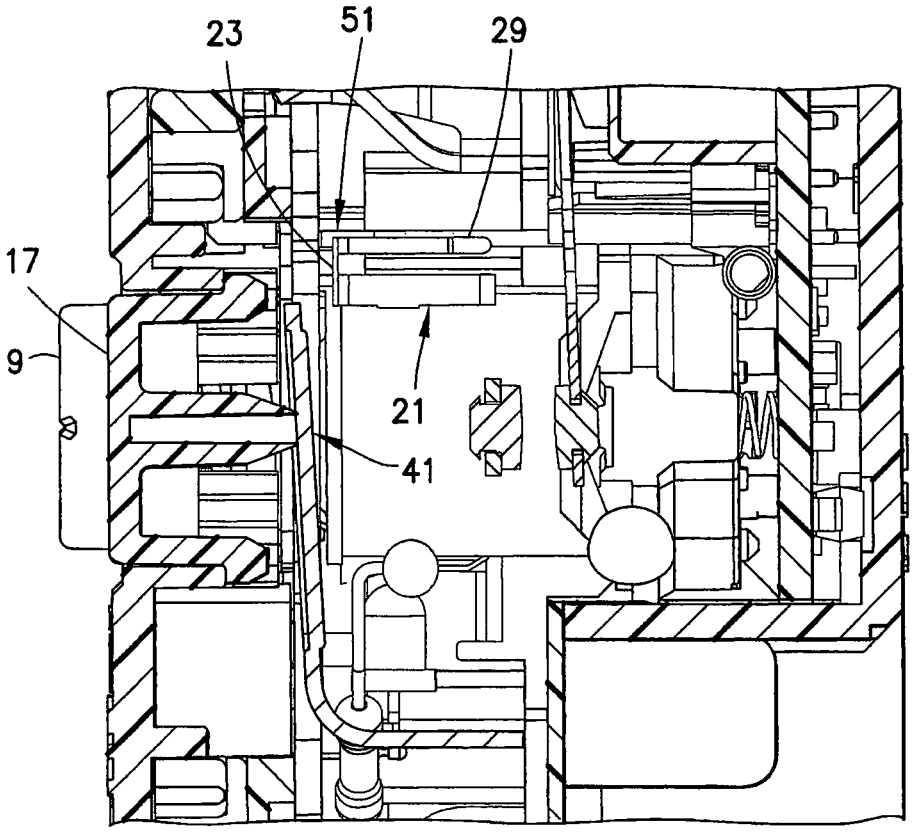
FIG. 4 is a partial side elevational view in section take along line 4-4 of FIG. 3.
Figure 6:
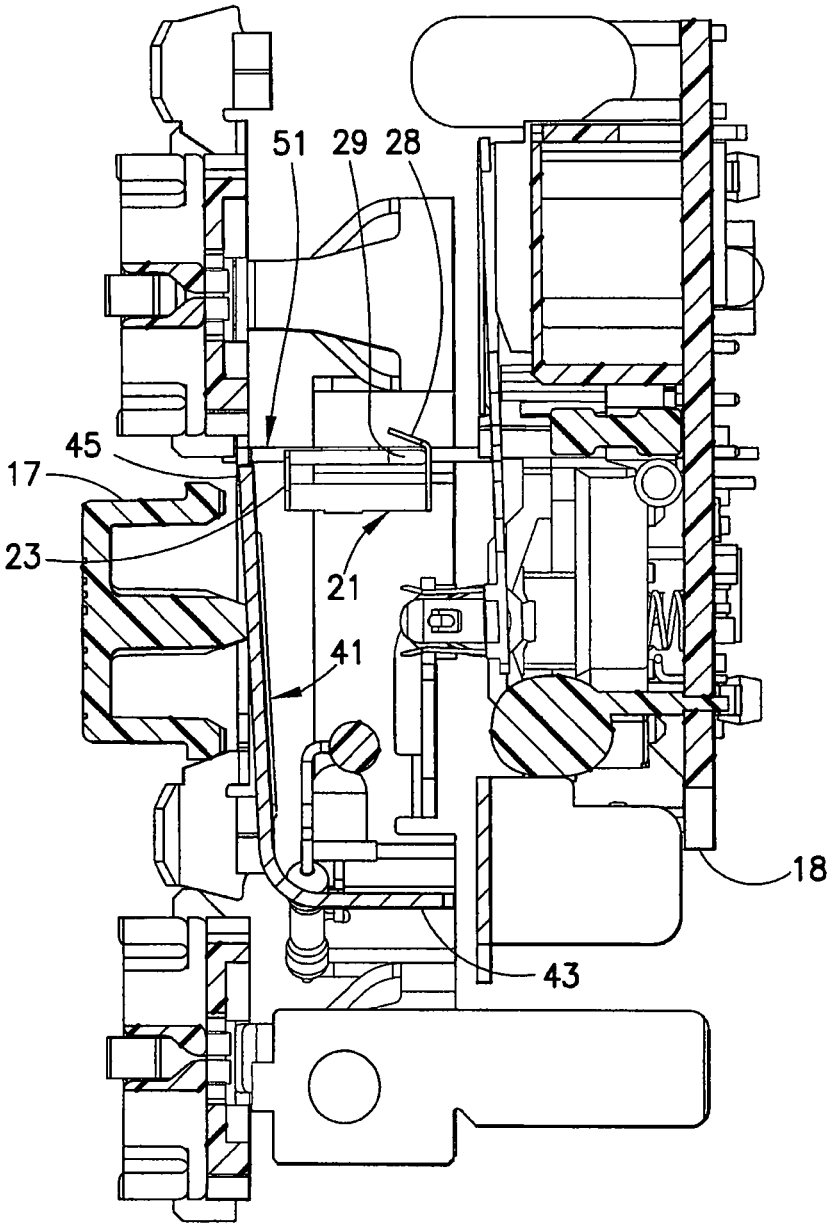
FIG. 6 is a side elevational view in partial cross section of the GFCI device of FIG. 5.
Figure 7:
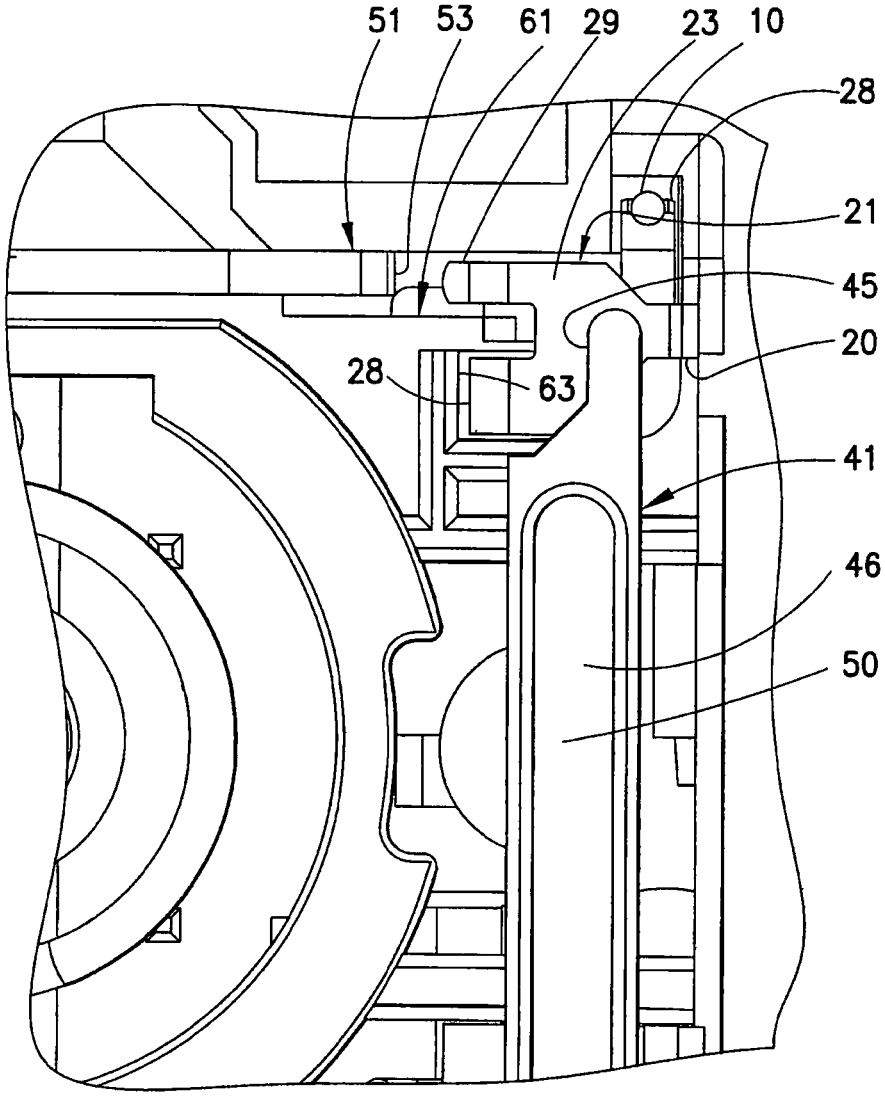
FIG. 7 is a partial top plan view of the GFCI device of FIG. 5 with the button removed.

A conductive member 51 is mounted in the base 15 of the GFCI device 11, as shown in FIGS. 4, 6 and 7. A contact surface 53 of the conductive member 51 is disposed proximal the second angled portion 29 of the rocker contact switch 21 such that the contact surface can be contacted by the second angled portion to put the GFCI device 11 in an end-of-life condition. The contact surface 53 is formed on a first portion 52 of the conductive member 51 and is connected to a second portion 54 by a right angle bend 56. The second portion 54 extends outwardly from a first portion 57 of the conductive member 51, and is preferably substantially perpendicular thereto. The conductive member 51 is made of an electrically conductive material, such as copper.

Figure 5:
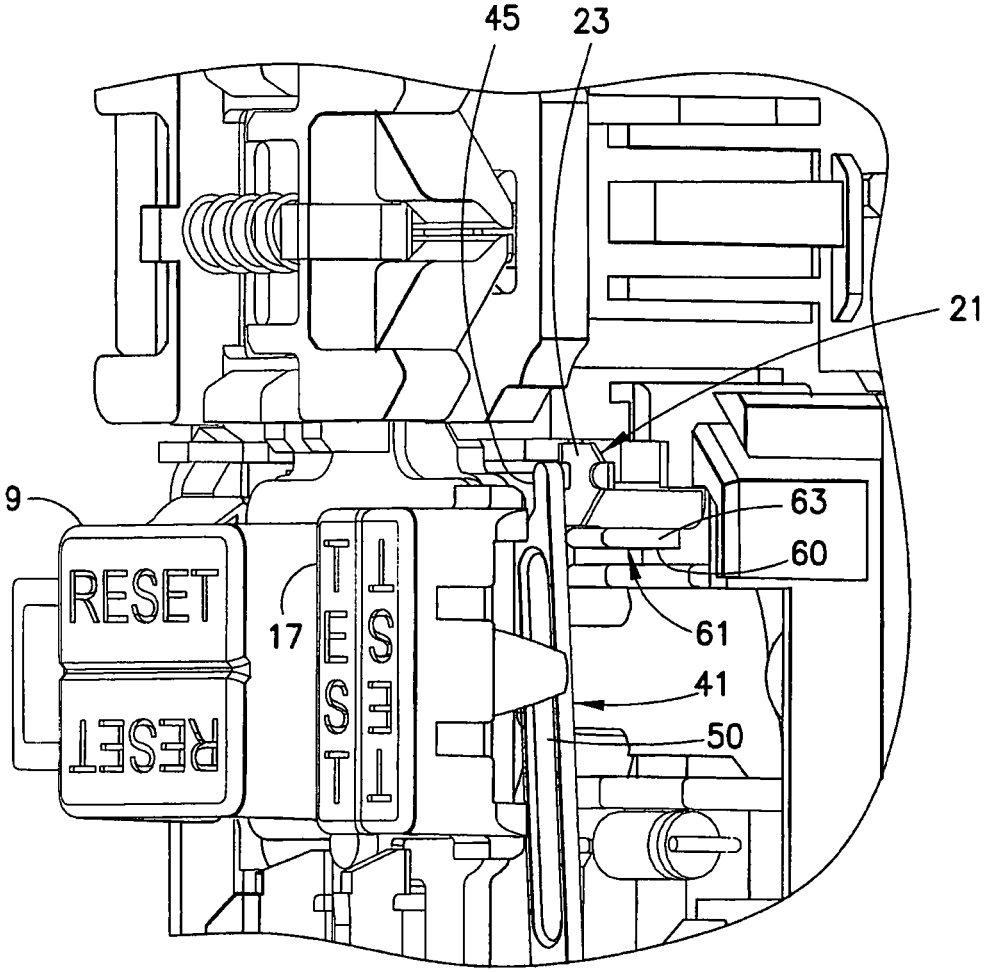
FIG. 5 is a front perspective view in partial cross section of the GFCI device of FIG. 1 with the cover removed.

A barrier 61 is mounted in the base 15 of the GFCI device 11, as shown in FIGS. 5 and 7. The barrier 61 has an arm 60 extending outwardly therefrom. A blocking surface 63 is disposed at a free end of the arm 60 and substantially prevents movement of the first leg 25 by contacting the first portion 26 of the first leg. The blocking surface 63 is disposed immediately adjacent the second portion 28 of the first leg 25. The blocking surface 63 substantially prevents movement of the first leg 25 when the rocker contact switch 21 is engaged by the spring beam 41. Preferably, the barrier 61 is made of plastic.

A rocker contact switch 221 in accordance with a second exemplary embodiment of the present invention is shown in FIGS. 19-22. The rocker contact switch 221 of FIGS. 19-22 is substantially similar to the rocker contact switch 21 of FIGS. 12-15, with the exception noted below, and operates in a substantially similar manner.

The rocker contact switch 221, as shown in FIGS. 19-22, includes a base 223 having first and second legs 225 and 227, respectively, extending therefrom. A tab 220 extends upwardly from the base 223 in a direction substantially opposite to that in which the first and second legs 225 and 227 extend. Preferably, the tab 220 is substantially perpendicular to the base 223. The tab 220 substantially prevents a spring beam 41 from moving off the base 223 when the spring beam engages the base of the rocker contact switch 221. Preferably, the rocker contact switch 221 is made of stainless steel.

The first leg 225 has a first portion 226 and a second portion 224. The second portion 224 has a first angled portion 228 adapted to mechanically and electrically engage a wire that is terminated by inserting the wire in the GFCI device 11. The first angled portion 228 of the first leg 225 has an angle θ to facilitate receiving an inserted wire. The angle θ is determined by the diameter of the wire 10 being inserted in the GFCI device. Preferably, the angle θ is approximately 70 degrees with respect to the wire prior to insertion thereof.

Figure 20:
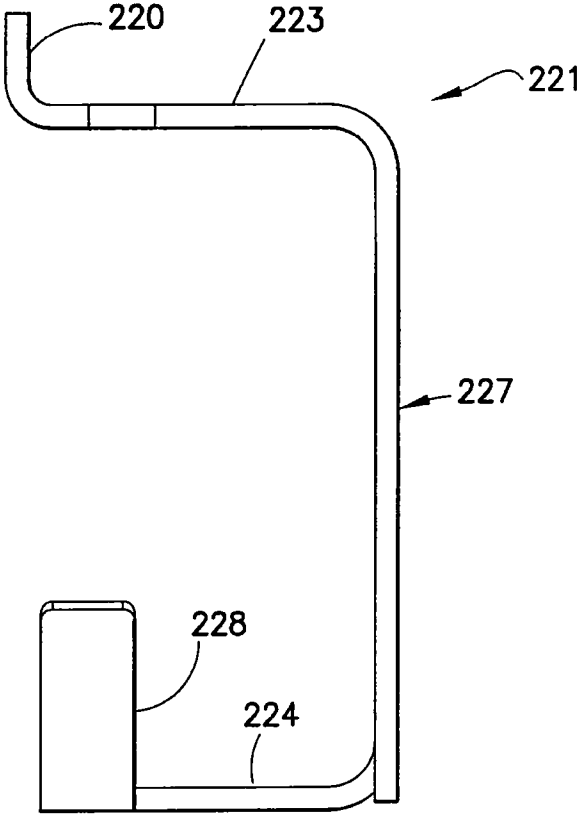
FIG. 20 is a side elevational view of the rocker contact switch of FIG. 19.
Figure 19:
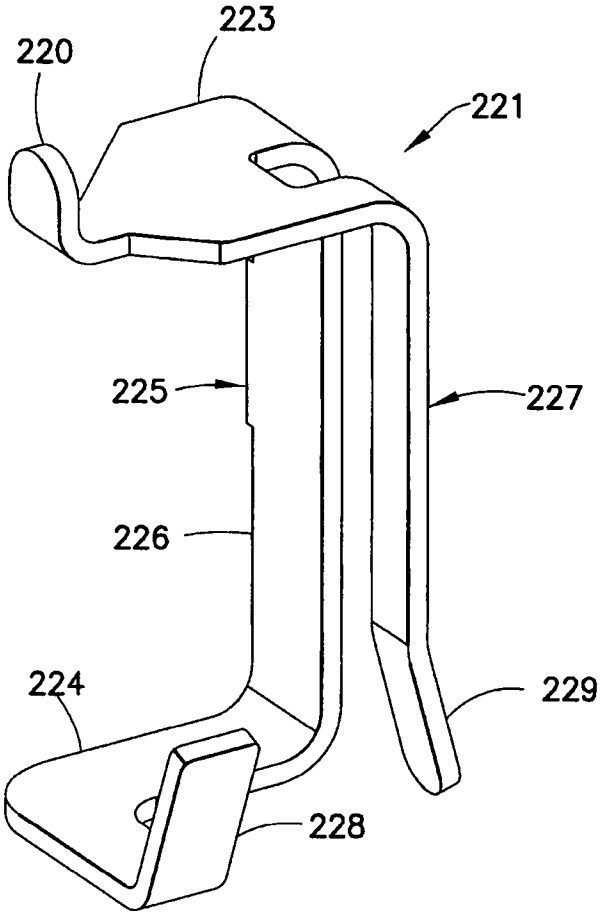
FIG. 19 is a perspective view of a rocker contact switch for a GFCI device according to a second exemplary embodiment of the present invention.
Figure 22:
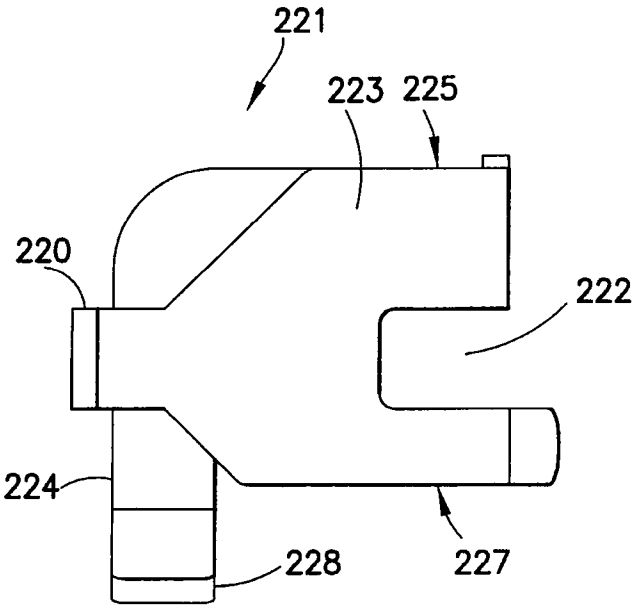
FIG. 22 is a top plan view of the rocker contact switch of FIG. 19.
Figure 21:
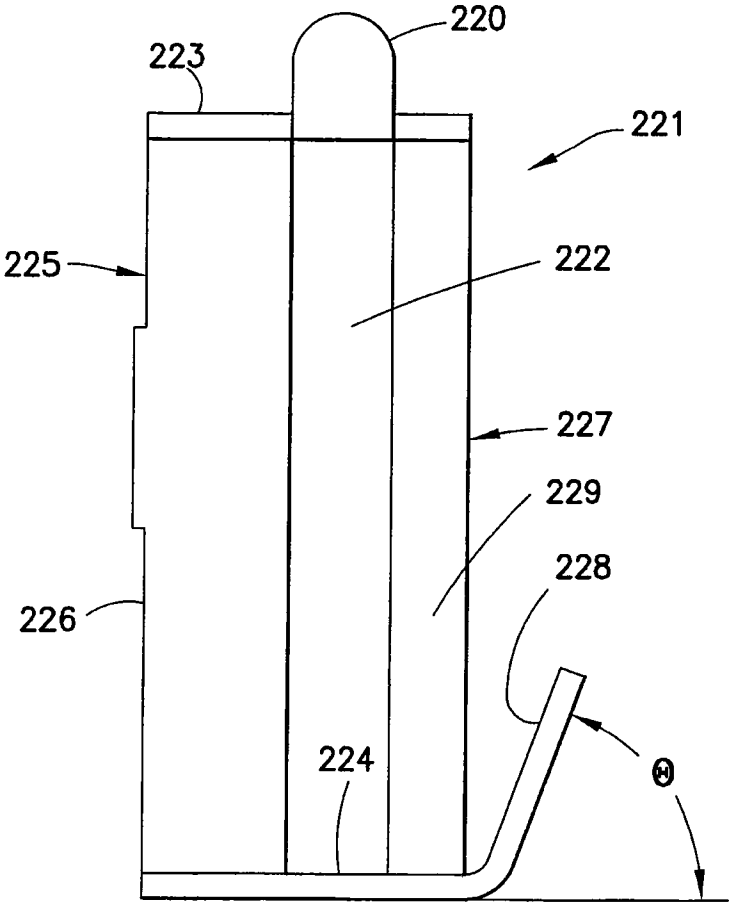
FIG. 21 is a front elevational view of the rocker contact switch of FIG. 19.

The second leg 227 of the rocker contact switch 221 is preferably substantially parallel to the first portion 226 of the first leg 225, as shown in FIGS. 19-21. A free end 229 of the second leg 227 is adapted to engage the conductive member 51. A gap 222 spaces the first portion 226 of the first leg from the second leg 227, as shown in FIGS. 14 and 15, such that the second leg is movable with respect to the first leg.

Assembly and Operation

A fully assembled GFCI device 11 is shown in FIGS. 1-3. Power is supplied to the GFCI device 11 either by connecting a plug (not shown) into the aperture 18 in the rear surface 19 of the GFCI device, by terminating wires through a push-in connection as shown in FIG. 7, or by any other suitable means.

Figure 17:
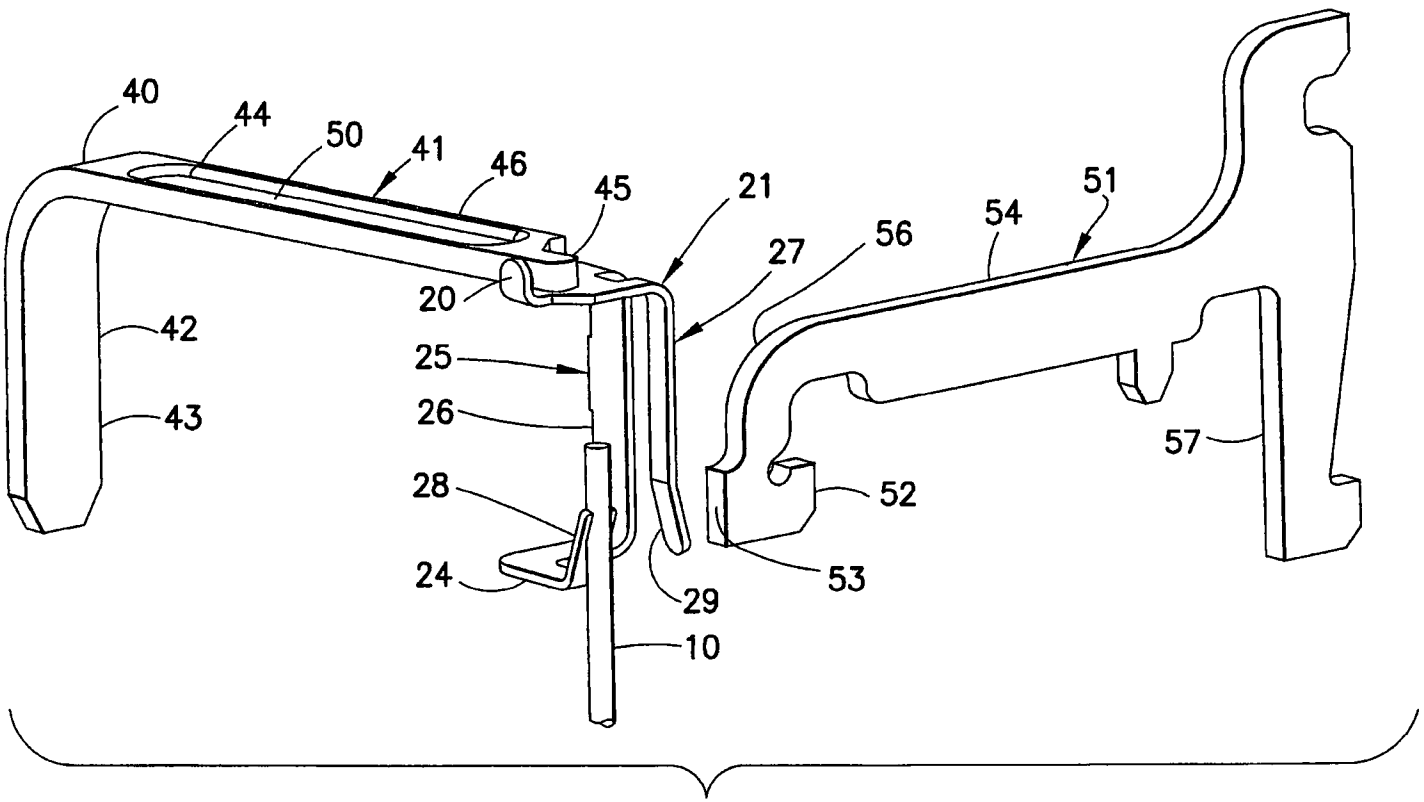
FIG. 17 is a perspective view of the rocker contact switch of FIG. 12 being contacted by the spring beam.
Figure 18:
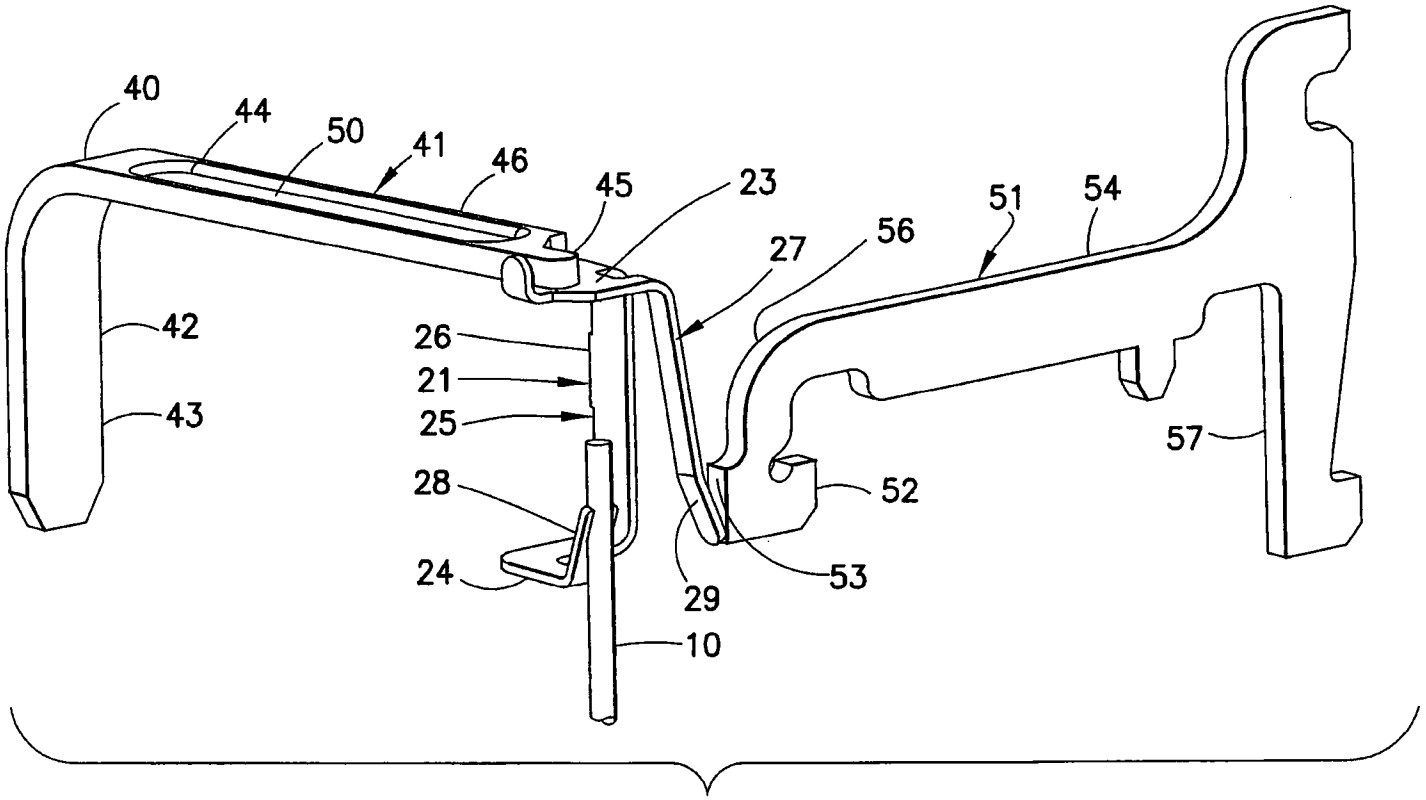
FIG. 18 is a perspective view of the rocker contact switch of FIG. 16 after being engaged by the spring beam and moving a leg thereof.
Figure 23A:
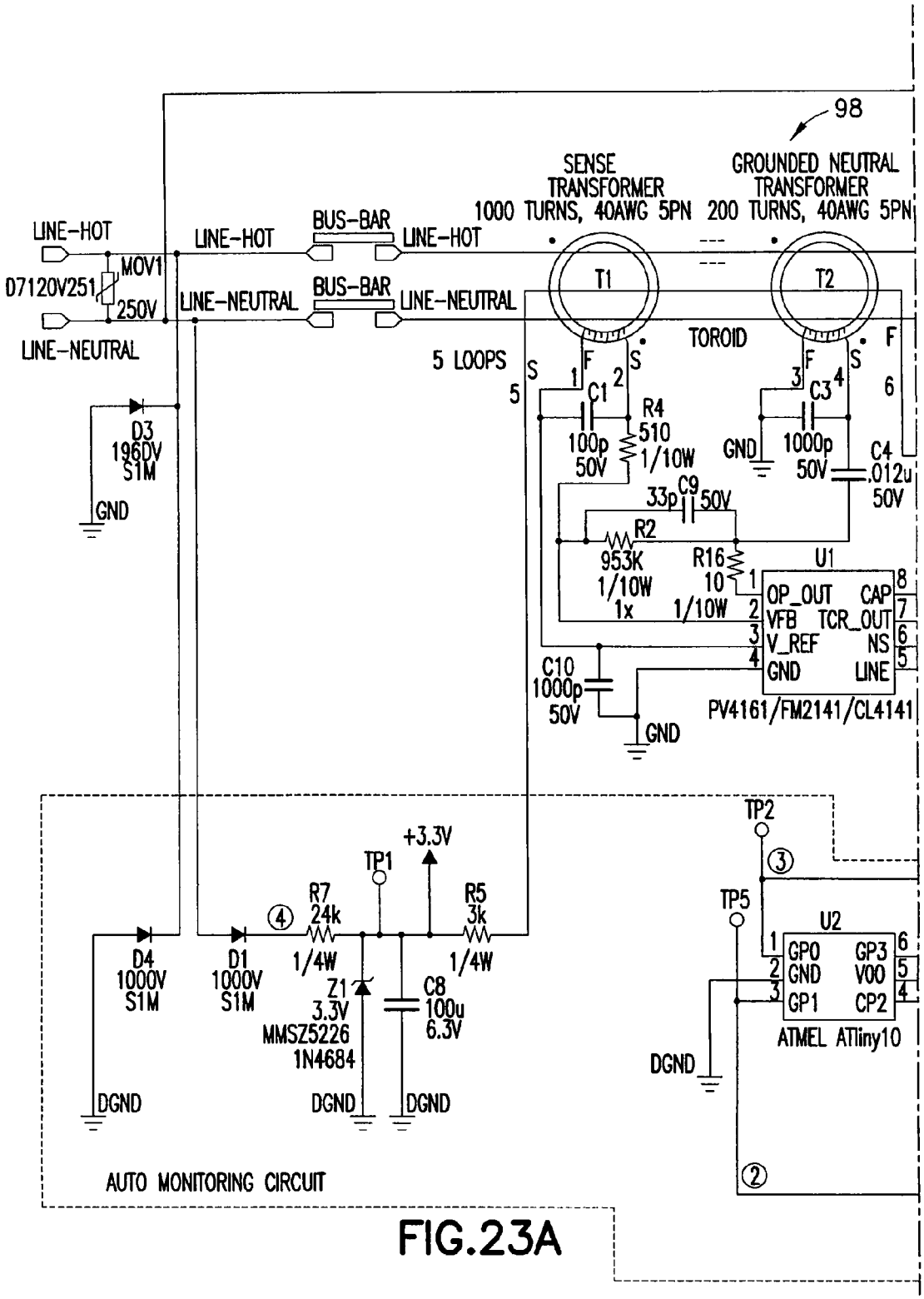
FIG. 23 is comprised of FIGS. 23A and 23B and is an electrical schematic diagram of the GFCI device of FIG. 1 or 8.
Figures 23, 23A, 23B:
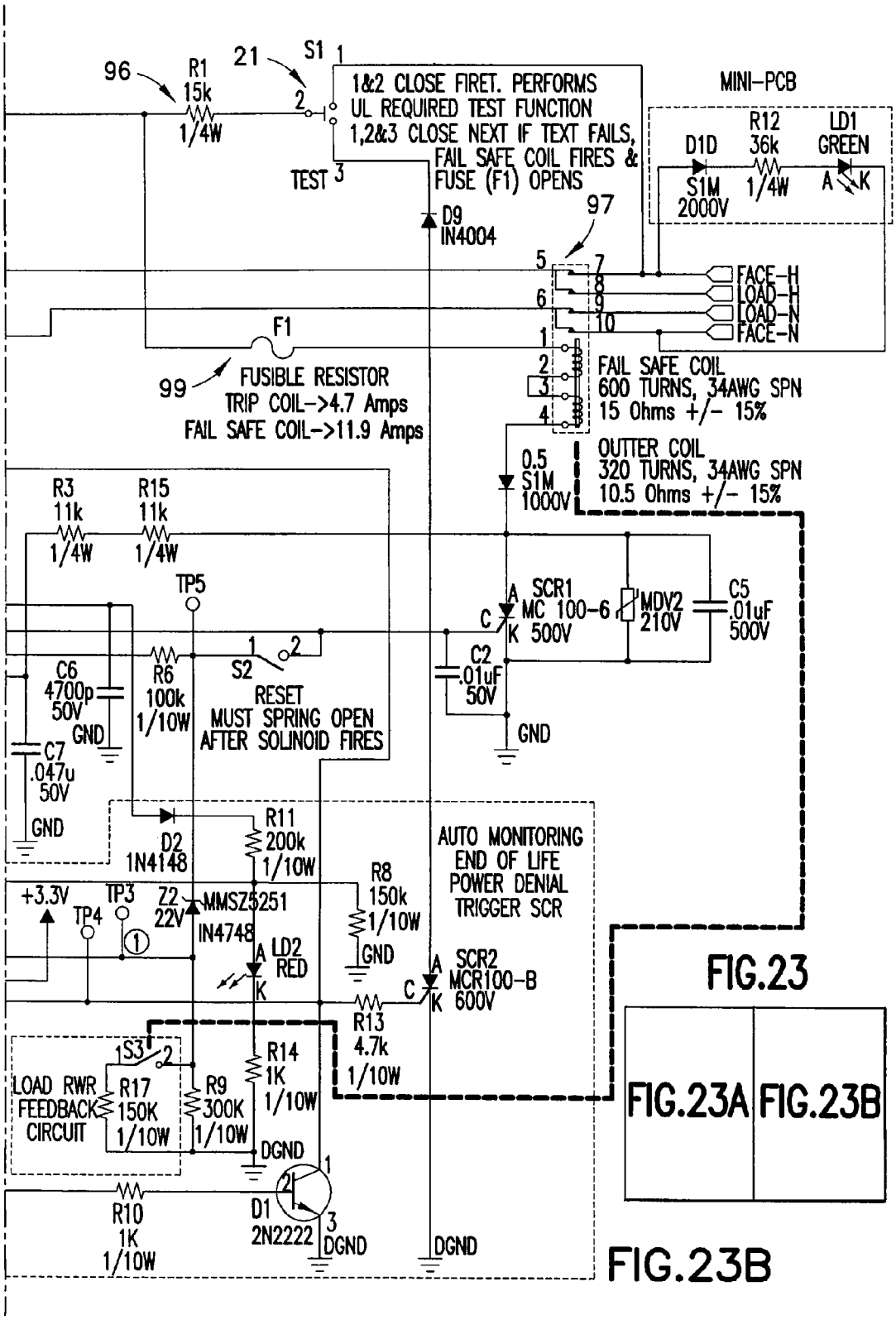

Operation of the rocker contact switch 21 is shown in FIGS. 16-18, in which only the rocker contact switch 21, inserted wire 10, spring beam 41 and conductive member 51 are shown for sake of clarity. During normal operation of the GFCI device, as shown in FIG. 16, the spring beam 41 is spaced from the base 23 of the rocker contact switch 21 and the angled portion 29 of the second leg 27 is spaced from the contact surface 53 of the conductive member 51. When the rocker contact switch 21 is in the position shown in FIG. 16, the diagram for the electrical circuit appears as shown in FIG. 23. During normal operation of the GFCI device, the rocker contact switch 21 does not make contact with points 1 or 3, such that no current imbalance is detected by the transformer assembly 98 and the GFCI device continues to operate normally.

To put the GFCI device in a tripped condition, as shown in FIG. 17, the test button 17 is pushed a first distance. The test button 17 engages an upper surface 46 of the spring beam 41 and moves the spring beam, thereby causing the free end 45 of the spring beam 41 to contact the base 23 of the rocker contact switch 21. Contact between the spring beam 41 and the rocker contact switch 21 completes a first circuit, thereby putting the GFCI device 11 in a tripped condition. As shown in FIG. 23, when the rocker contact switch 21 is in the position shown in FIG. 17, contact is made between points 2 and 1 in the diagram such that an amperage is provided by a resistor 96. Accordingly, an imbalance is detected by the transformer assembly 98, which causes switches 97 to open, thereby tripping the GFCI device. When the GFCI device trips, the reset button 9 pops out, thereby providing a user with audible and visual indicia that the GFCI device has tripped. Additionally, the indicator light 12 goes out when the GFCI device is in a tripped condition.

To put the GFCI device in an end-of-life condition, as shown in FIG. 18, the test button 17 is pushed further to a second distance, which is greater than the first distance. The force required to push the test button 17 the second distance is greater than that required to push the test button the first distance. Pushing the test button 17 the first distance to trip the GFCI device causes the test button to engage the spring beam 41 such that little force is required to move the test button. Pushing the test button 17 the second distance to put the GFCI device in the end-of-life condition requires the push button to move the spring beam 41 to cause the rocker contact to overcome the blocking surface 63 and rotate such that the second leg 27 contacts the contact surface 53 of the conductive member 51. Accordingly, the increased force required to push the test button 17 the second distance is further indication to a user that the push button is moving from the tripped condition to the end-of-life condition.

The tab 20 of the rocker contact switch 21 facilitates engagement between the spring beam 41 and the base 23 of the rocker contact switch. The free end 45 of the spring beam pushes on the base 23 of the rocker contact switch 21, which causes the second leg 27 of the rocker contact switch to rotate. The first leg 25 of the rocker contact switch 21 is substantially prevented from rotating by the presence of the blocking surface 63 of the arm 60 of the barrier 61 (FIG. 5). Accordingly, the first leg 25 bends relative to the base 23 as the base and second leg are rotated by the spring beam 41. The rotation of the second leg 27 causes the angled portion 29 to contact the contact surface 53 of the conductive member 51, thereby completing a second circuit to put the GFCI device 11 in an end-of-life condition if the GFCI did not trip after the test button moved through the first distance. For the rocker contact switch 221 of FIGS. 19-21, the free end 229 of the second leg 227 contacts the contact surface 53 of the conductive member 51 to put the GFCI device in the end-of-life condition. Preferably, the distance the second angled portion 29 of the rocker contact switch is moved is two-and-a-half times the distance that the spring beam 41 is moved to put the GFCI device in the end-of-life condition. The test button is pushed a first distance (FIG. 17) to put the GFCI device 11 in the tripped condition. The first distance could be, for example, approximately 0.029 inches. The test button is pushed a second distance (FIG. 18) to put the GFCI device 11 in the end-of-life condition. The second distance could be, for example, approximately 0.045 inches (measured from the normal operating position of the spring beam 41 shown in FIG. 16, i.e., approximately an additional 0.016 inches from the first distance).

As shown in FIG. 23, when the rocker contact switch 21 is in the position shown in FIG. 18, contact is made between points 2, 1 and 3 in the diagram. A voltage is sent through the fuse 99 that causes the fuse to blow, such that the GFCI device is put in an end-of-life condition.

When the GFCI device is successfully tripped, as discussed above, there is no electrical current available to blow the fuse 99. Thus, if the test button 17 is pushed from the tripped condition (FIG. 17) to the end-of-life condition (FIG. 18) when the GFCI device has been successfully tripped, there is no current available to send the voltage to blow the fuse 99. Therefore, the GFCI device can be put back into normal operating mode without destroying the GFCI device. Thus, if the GFCI device is manually tripped, the GFCI device cannot be put in an end-of-life condition. If the GFCI device fails to trip when manually put in the tripped condition, then further moving the test button puts the GFCI device in the end-of-life condition. Accordingly, the rocker contact switch avoids prematurely putting the GFCI device in the end-of-life condition.

Accordingly, the rocker contact switch according to exemplary embodiments of the present invention provides a GFCI device in which more than one member is moved to put the GFCI device in the tripped and end-of-life conditions. The spring beam 21 is first moved to contact the rocker contact switch 21 to put the GFCI device 11 in the tripped condition. The second leg 27 of the rocker contact switch 21 is then moved to contact the conductive member 51 to put the GFCI device 11 in an end-of-life condition. Thus, the GFCI device of the exemplary embodiments of the present invention overcomes the disadvantages associated with existing GFCI devices in which only the spring beam is moved to put the GFCI device in either the tripped or end-of-life condition. Specifically, the rocker contact switch according to exemplary embodiments of the present invention prevents the GFCI from being put in an end-of-life condition prior to being tripped.

While a number of advantageous embodiments have been chosen to illustrate the invention, it will be understood by those skilled in the art that various changes and modifications may be made therein without departing from the scope of the invention as defined in the appended claims.

What is claimed is:

1. A rocker contact switch for an electrical device, comprising:

a movable base;

a fixed first leg extending from said base; and a movable second leg extending from said base, said second leg being movable to contact a conductive member to put the electrical device in an end of life condition while said first leg remains substantially stationary during movement of said base.

2. The rocker contact switch of claim 1, wherein said first leg has a first portion and a second portion, said second portion being mechanically and electrically engagable with a wire inserted in the electrical device.

3. The rocker contact switch of claim 2, wherein said second portion of said first leg has a first angled portion to prevent withdrawal of the inserted wire.

4. The rocker contact switch of claim 1, wherein said second leg is substantially parallel to said first portion of said first leg.

5. The rocker contact switch of claim 1, wherein said second leg has a second angled portion to facilitate engaging the conductive member.

6. The rocker contact switch of claim 3, wherein said first angled portion has an angle of approximately 70 degrees relative to a planar portion of said second portion of said first leg.

7. The rocker contact switch of claim 5, wherein said second angled portion has an angle of approximately 14 degrees.

8. The rocker contact switch of claim 1, wherein a gap spaces said first leg from said second leg.

9. A GFCI device, comprising:

a housing;

a button accessible on an outer surface of said housing and movable by first and second distances relative to said housing;

a spring beam movable within said housing and engaged by said button when said button moves said first distance to cause tripping of said GFCI device; and a rocker contact switch disposed within said housing, said rocker contact switch including a movable base disposed within said housing;

a fixed first leg extending from said base; and a movable second leg extending from said base, said button moving said spring beam to engage said base causing said second leg to move and to contact a conductive member to put the GFCI device in an end of life condition in response to said button being pushed said second distance.

10. The GFCI device of claim 9, wherein a strengthening member is disposed in the spring beam to substantially prevent bowing thereof.

11. The GFCI device of claim 9, wherein said second leg has a second angled portion to facilitate engaging said conductive member.

12. The GFCI device of claim 9, wherein said first leg has a first portion and a second portion, said second portion mechanically and electrically engaging a wire inserted in the GFCI device.

13. The GFCI device of claim 12, wherein said second portion of said first leg has a first angled portion to prevent withdrawal of the inserted wire.

14. The GFCI device of claim 9, wherein said second leg is substantially parallel to said first portion of said first leg.

15. The GFCI device of claim 13, wherein said first angled portion has an angle of approximately 70 degrees relative to a planar portion of said second portion of said first leg.

16. The GFCI device of claim 11, wherein said second angled portion has an angle of approximately 14 degrees relative to a non-angled portion of said second leg.

17. The GFCI device of claim 9, wherein said second leg is displaceable a first distance approximately two-and-a-half times a second distance of displacement of said spring beam when said button is pushed said second distance.

18. A method of operating a GFCI device; comprising the steps of pushing a button on the GFCI device a first distance to complete a first circuit by engaging a spring beam with a base of a rocker contact switch to trip the GFCI device; and pushing a button a second distance, greater than the first distance, to complete a second circuit by moving the spring beam to move the base such that a second leg moves to contact a conductive member to put the GFCI device in an end of life condition.

19. The method of claim 18, wherein the first distance is approximately 0.029 inches.

20. The method of claim 18, wherein the second distance is approximately 0.045 inches.

* * * * *